US009199809B2

(12) United States Patent
Hamasaki et al.

(10) Patent No.: US 9,199,809 B2
(45) Date of Patent: Dec. 1, 2015

(54) SHEET FEEDING DEVICE AND IMAGE FORMING APPARATUS

(71) Applicant: CANON KABUSHIKI KAISHA, Tokyo (JP)

(72) Inventors: Ryuji Hamasaki, Zhongshan (CN); Daisuke Usami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/151,545

(22) Filed: Jan. 9, 2014

(65) Prior Publication Data

US 2014/0203496 A1 Jul. 24, 2014

(30) Foreign Application Priority Data

Jan. 18, 2013 (JP) ..... 2013-007315

(51) Int. Cl.

| | |
|---|---|
| ***B65H 1/18*** | (2006.01) |
| ***B65H 1/26*** | (2006.01) |
| ***B65H 1/14*** | (2006.01) |
| ***B65H 7/06*** | (2006.01) |

(52) U.S. Cl.

CPC ..... *B65H 1/266* (2013.01); *B65H 1/14* (2013.01); *B65H 1/18* (2013.01); *B65H 7/06* (2013.01); *B65H 2402/62* (2013.01); *B65H 2402/63* (2013.01); *B65H 2403/42* (2013.01); *B65H 2403/544* (2013.01); *B65H 2405/15* (2013.01); *B65H 2405/32* (2013.01); *B65H 2511/152* (2013.01); *B65H 2511/20* (2013.01); *B65H 2511/417* (2013.01); *B65H 2511/51* (2013.01); *B65H 2511/515* (2013.01); *B65H 2601/271* (2013.01); *B65H 2801/06* (2013.01)

(58) Field of Classification Search

CPC ..... B65H 1/18; B65H 1/30; B65H 1/266; B65H 7/02; B65H 7/04; B65H 7/14; B65H 7/20; B65H 2553/00; B65H 2511/51; B65H 2511/515; B65H 2511/152; B65H 2601/271; B65H 2405/32

USPC ..... 271/152–155

See application file for complete search history.

(56) References Cited

U.S. PATENT DOCUMENTS

| | | | | |
|---|---|---|---|---|
| 7,753,366 | B2 * | 7/2010 | Kawanishi et al. | 271/153 |
| 2007/0052155 | A1 * | 3/2007 | Cook et al. | 271/152 |
| 2010/0322689 | A1 * | 12/2010 | Ohtani et al. | 399/388 |
| 2011/0140341 | A1 * | 6/2011 | Nishikata et al. | 271/3.09 |
| 2013/0113157 | A1 * | 5/2013 | Fujita | 271/126 |

FOREIGN PATENT DOCUMENTS

JP 2010-241527 A 10/2010

* cited by examiner

*Primary Examiner* — Prasad Gokhale

(74) *Attorney, Agent, or Firm* — Canon USA, Inc. IP Division

(57) ABSTRACT

A sheet feeding device includes a sheet storage unit, a stacking unit, a raising unit, a sheet detection unit, an attachment detection unit, and a control unit. The sheet storage unit may be attached to and drawn out of an apparatus main body. The stacking unit is raised by the raising unit and is lowered when the sheet storage unit is drawn out. The attachment detection unit detects attachment of the sheet storage unit to the apparatus main body. The control unit determines whether an amount of sheets stacked on the stacking unit exceeds a predetermined amount based on detection results. If the sheet detection unit continues to detect sheets when the sheet storage unit goes from attached, to not attached, to attached to the apparatus main body, the control unit determines that the amount of sheets stacked on the stacking unit does not exceed the predetermined amount.

22 Claims, 15 Drawing Sheets

SHEET FEEDING DEVICE AND IMAGE FORMING APPARATUS

BACKGROUND OF THE INVENTION

1. Field of the Invention

The present invention relates to a sheet feeding device configured to feed sheets and an image forming apparatus equipped with the same.

2. Description of the Related Art

Generally speaking, an image forming apparatus such as a copying machine, a printer, or a facsimile apparatus has, in the image forming unit thereof, a sheet feeding device configured to feed sheets. The sheet feeding device is equipped with a sheet storage unit storing sheets to be fed, and the sheet storage unit can be drawn out of the apparatus main body so that the user can replenish the sheet storage unit with sheets.

Japanese Patent Application Laid-Open No. 2010-241527 discusses a sheet feeding device having a stacking unit which can be drawn out of the feeding device and on which sheets are stacked, a cassette detection unit configured to detect whether the sheet stacking unit is attached to the feeding device, a drive unit configured to raise the stacking unit, and a sheet presence detection unit configured to detect whether sheets are stacked on the stacking unit.

In the sheet feeding device discussed in Japanese Patent Application Laid-Open No. 2010-241527, in the case where the sheet presence detection unit detects the presence of sheets when it is detected by the cassette detection unit that the stacking unit has been attached to the feeding device, it is determined that the stacking unit is overloaded with sheets.

In the sheet feeding device discussed in Japanese Patent Application Laid-Open No. 2010-241527, when it is determined that there is overloading, the feeding operation is inhibited, whereby it is possible to prevent defective sheet feeding in the case of overloading.

However, in the sheet feeding device discussed in Japanese Patent Application Laid-Open No. 2010-241527, there is the possibility of erroneous detection of overloading in a case as follows.

That is, in a case where the user draws the stacking unit out of the feeding device only by a small amount, and attaches it to the feeding device again, the stacking unit remains raised by a drive unit, and the sheet presence detection unit detects the presence of a sheet. That is, in the sheet feeding device discussed in Japanese Patent Application Laid-Open No. 2010-241527, it may be erroneously determined that there is overloading although, in fact, there is no overloading.

SUMMARY OF THE INVENTION

The present invention is directed to a sheet feeding device capable of preventing erroneous detection of overloading, and to an image forming apparatus equipped with the same. In an example, a control unit determines that there is no overloading when an uppermost surface detection unit continues to detect sheets in a series of processes in which an attachment detection unit changes from a state in which the attachment of a cassette deck is detected to a state in which the attachment of the cassette deck is not detected and, further, to the state in which the attachment of the cassette deck is detected.

According to an aspect of the present invention, a sheet feeding device configured to feed sheets, the sheet feeding device includes a sheet storage unit configured to store sheets, wherein the sheet storage unit is configured to be attached to and drawn out of an apparatus main body, a stacking unit provided in the sheet storage unit and configured to allow sheets to be stacked thereon, a raising unit configured to raise the stacking unit, wherein the stacking unit is lowered when the sheet storage unit is drawn out of the apparatus main body, a sheet detection unit provided in the apparatus main body and configured to detect a sheet, the sheet detection unit detecting a sheet stacked on the stacking unit when the stacking unit is raised by the raising unit, an attachment detection unit configured to detect attachment of the sheet storage unit to the apparatus main body, and a control unit configured to determine whether an amount of sheets stacked on the stacking unit exceeds a predetermined amount based on results of detection by the sheet detection unit and the attachment detection unit, wherein the control unit determines that the amount of sheets stacked on the stacking unit does not exceed the predetermined amount when the sheet detection unit continues to detect sheets in a series of processes in which the result of detection by the attachment detection unit changes from a first state in which the attachment of the sheet storage unit is detected to a second state in which the attachment of the sheet storage unit is not detected and, further, to the first state in which the attachment of the sheet storage unit is detected.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
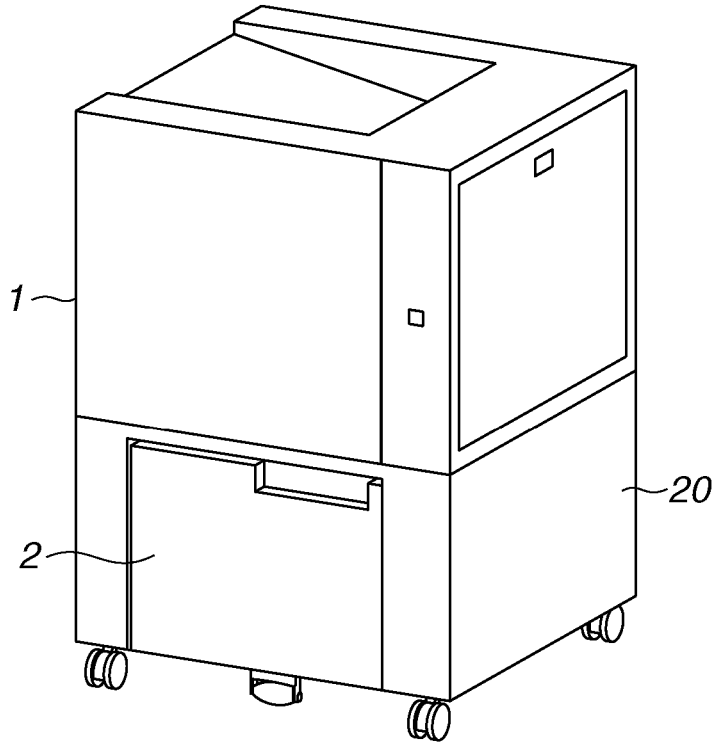
FIG. 1 is an overall perspective view of an image forming apparatus according to a first exemplary embodiment.

FIG. 1 is an overall perspective view of an image forming apparatus according to a first exemplary embodiment. An image forming apparatus main body 1 has an image forming unit configured to form an image on a sheet. A deck main body 20 is detachably attached to the image forming apparatus main body 1 as a feeding option. The feeding option is attached to the image forming apparatus as desired by the user in order to store sheets and supply them to the image forming apparatus. It is used for the purpose of storing and supplying a large amount of sheets or of supplying sheets of different sizes. A cassette deck 2 has a sheet storage unit for storing sheets, and is detachably attached to the deck main body 20.

The sheets stored in the cassette deck 2 are fed toward the image forming apparatus main body 1, and the sheets that have undergone image forming by the image forming unit are discharged to the exterior of the image forming apparatus main body 1. As the construction of the image forming unit, etc., of the image forming apparatus main body 1, it is possible to adopt a well-known construction as discussed in Japanese Patent Application Laid-Open No. 2010-241527, and a description thereof will be left out.

Figure 2:
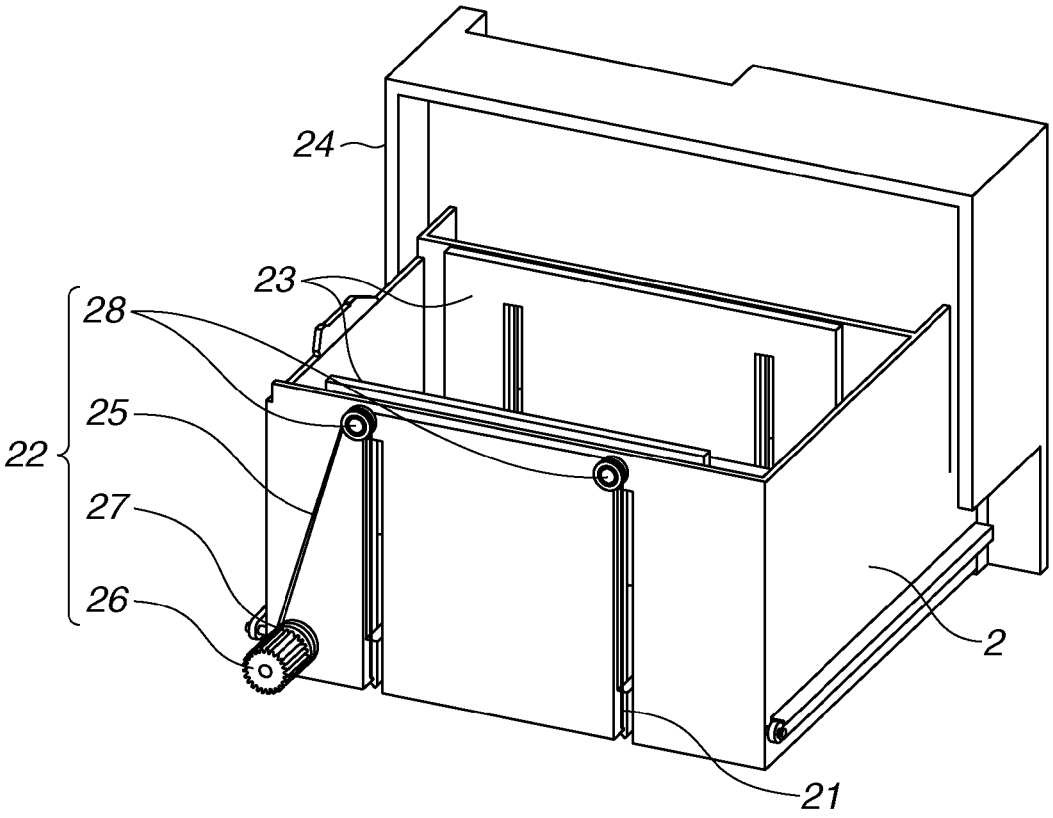
FIG. 2 is a perspective view of a cassette deck as seen from the rear side.

FIG. 2 is a perspective view of the cassette deck 2 as seen from the rear side.

The cassette deck 2 is equipped with a stacking plate 21 as a stacking unit for stacking sheets, an elevation unit (raising unit) 22 for raising and lowering the stacking plate 21, sheet regulation plates 23 for regulating the position of the sheets, and an exterior cover 24.

The elevation unit 22 is equipped with a wire 25 connected to the stacking plate 21, an elevation connection gear 26 for transmitting drive force from a drive source provided on the apparatus main body side, and a wire take-up pulley 27 configured to rotate with the elevation connection gear 26 and to take up the wire 25. Further, the elevation unit 22 is equipped with a rotary pulley 28 for changing the route of the wire 25 to cause the stacking plate 21 to be raised and lowered in the vertical direction.

The elevation connection gear 26 rotates, and the wire 25 is taken up by the wire take-up pulley 27, whereby the stacking plate 21 is raised. When the connection between the elevation connection gear 26 and the drive source provided on the apparatus main body side is cut off, the stacking plate 21 descends due to its own weight.

Figure 3:
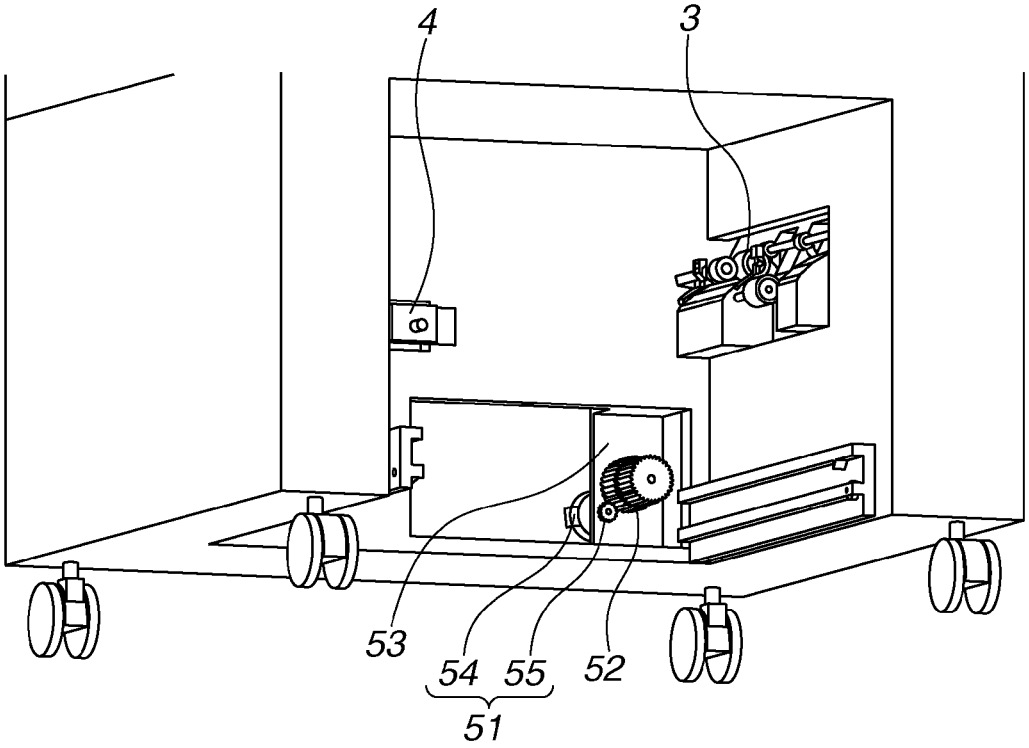
FIG. 3 is a perspective view of a deck main body with the cassette deck removed from it.

FIG. 3 is a perspective view of the deck main body 20 with the cassette deck 2 removed from it. The deck main body 20 is equipped with a feeding unit 3 configured to feed sheets, an attachment detection unit 4 configured to detect the attachment of the cassette deck 2 to the deck main body 20, and an elevation drive source unit 5 serving as the drive source of the elevation unit 22.

As illustrated in FIG. 3, the elevation drive source unit 5 is equipped with an elevation drive motor 51, an drive connection gear 52, and a drive source unit casing 53. The elevation drive motor 51 has a motor base 54 and a motor gear 55, and, through mesh-engagement between the motor gear 55 and the drive connection gear 52, the rotation of the elevation drive motor 51 is transmitted to the drive connection gear 52, thereby rotating the drive connection gear 52.

Figure 4:
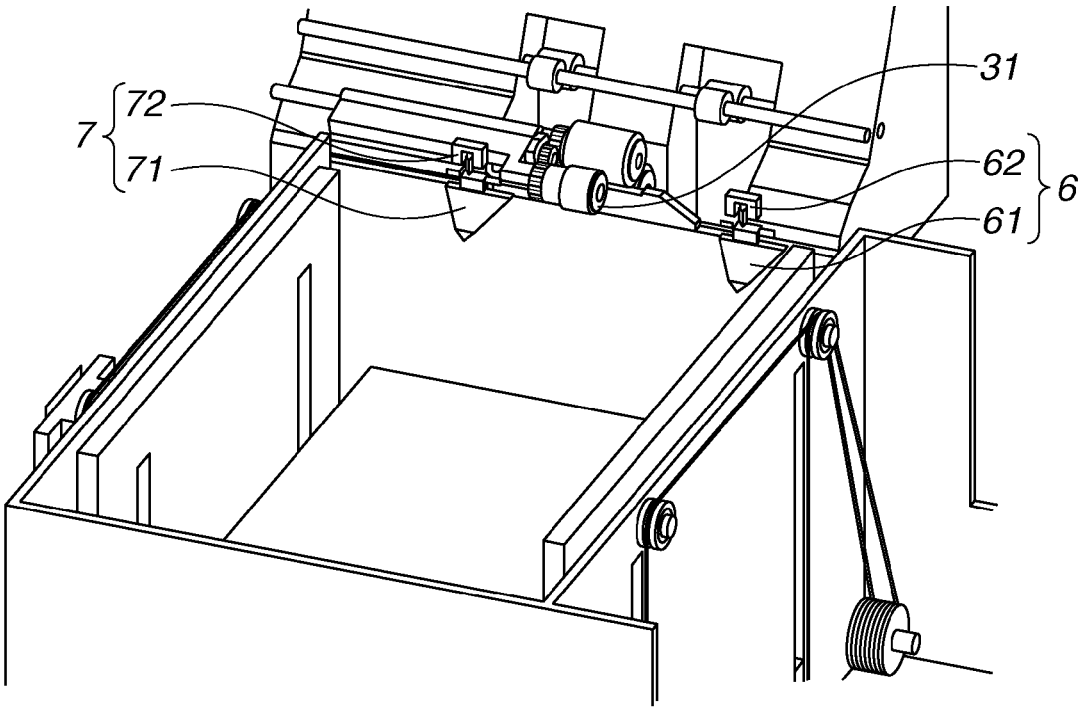
FIG. 4 is a perspective view of the deck main body with the cassette deck attached thereto.

FIG. 4 is a perspective view of the deck main body 20 with the cassette deck 2 attached thereto. The feeding unit 3 has a feeding roller 31 for feeding the sheets stacked on the cassette deck 2 one by one to the image forming apparatus main body 1. Further, the deck main body 20 is provided with a detection unit configured to detect a sheet stacked on the stacking plate when the stacking plate 21 is raised by the elevation unit 22.

The deck main body 20 is provided with, as the sheet detection unit, an uppermost surface detection unit 6 for detecting an uppermost sheet surface 10 of the sheets stacked on the stacking plate 21. When there are no sheets on the stacking plate 21, the uppermost surface detection unit 6 detects a stacking plate upper surface 11 of the stacking plate 21. Further, the deck main body 20 is provided with a sheet presence detection unit 7 configured to detect whether sheets are stacked on the stacking plate 21.

The uppermost surface detection unit 6 is equipped with an uppermost surface detection flag 61 and an uppermost surface detection sensor 62, and is provided on the upper side of the deck main body 20. Normally, the uppermost surface detection flag 61 drops downwards due to gravity. In this state, the uppermost surface detection sensor 62 detects no sheet (OFF). When the cassette deck 2 is attached to the deck main body 20, and the stacking plate 21 is raised by the elevation unit 22, the uppermost surface detection flag 61 is raised by a sheet surface 10 on the stacking plate 21. As a result, the uppermost surface detection sensor 62 detects a sheet on the stacking plate 21 (ON). Even when no sheet is stacked on the stacking plate 21, the uppermost surface detection flag 61 is raised by a stacking plate upper surface 11, whereby the uppermost surface detection sensor 62 detects that the stacking plate 21 has been raised to a predetermined position (ON).

Figure 5:
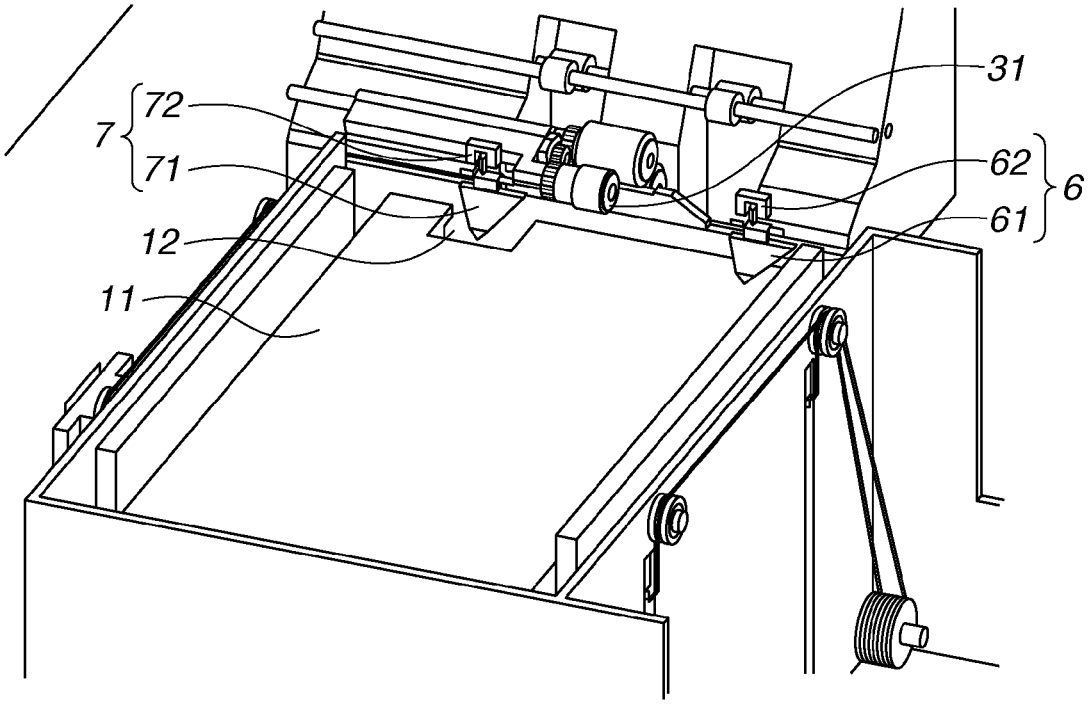
FIG. 5 is a perspective view of the deck main body in a state in which there are no sheets on a stacking plate.

The sheet presence detection unit 7 is equipped with a sheet presence detection flag 71 and a sheet presence detection sensor 72, and is provided on the upper side of the deck main body 20. Normally, the sheet presence detection flag 71 drops downwards due to gravity. In this state, the sheet presence detection sensor 72 detects no sheet (OFF). When the stacking plate 21 is raised by the elevation unit 22, and the uppermost surface detection unit 6 detects the sheet surface 10, the raising of the stacking plate 21 is stopped. At this time, when there is a sheet on the stacking plate 21, the sheet presence detection flag 71 is raised by the sheet surface 10, whereby the sheet presence detection sensor 72 detects the presence of the sheet (ON). FIG. 5 is a perspective view of the deck main body 20 when there is no sheet on the stacking plate 21. On the other hand, as illustrated in FIG. 5, when there is no sheet on the stacking plate 21, the sheet presence detection flag 71 drops into a stacking plate hole portion 12 provided in the stacking plate 21. Thus, the sheet presence detection flag 71 is not raised, so that the sheet presence detection sensor 72 does not detect that there is a sheet (OFF).

Figure 6:
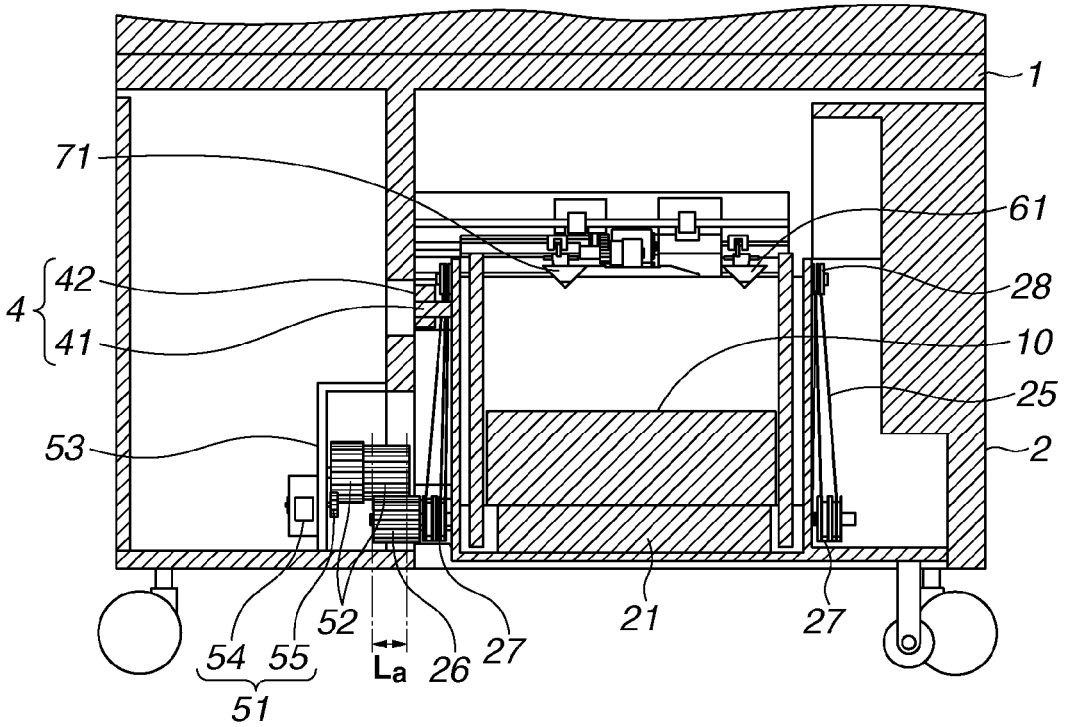
FIG. 6 is a diagram illustrating a state in which the cassette deck has been attached to the deck main body and in which an elevation drive source unit and an elevation unit are connected to each other.
Figure 7:
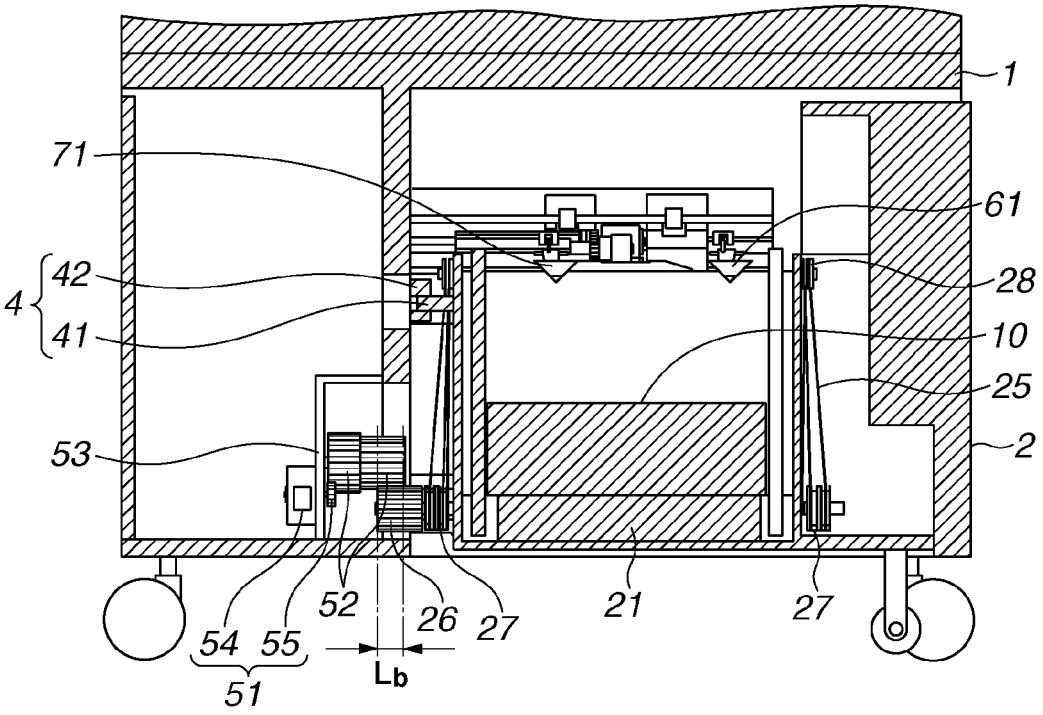
FIG. 7 is a diagram illustrating a state in which the cassette deck is being attached to the deck main body.
Figure 8:
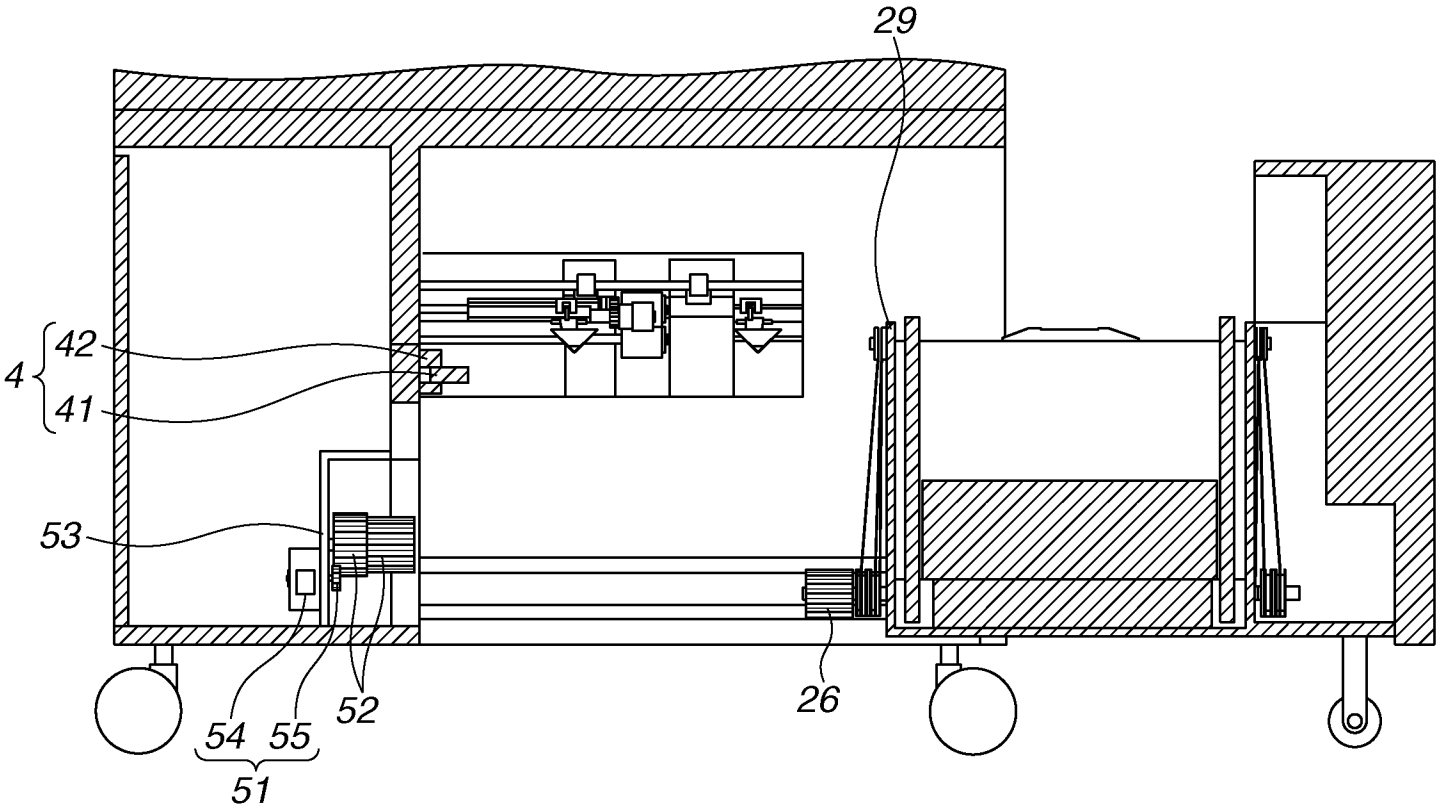
FIG. 8 is a diagram illustrating a state in which the cassette deck has been drawn out of the deck main body and in which the stacking plate has been lowered to the lowermost position.

FIG. 6 is a diagram illustrating the state in which the cassette deck 2 has been attached to the deck main body 20 and in which the elevation drive source unit 5 and the elevation unit 22 are connected to each other. FIG. 7 is a diagram illustrating the state in which the cassette deck 2 is being attached to the deck main body 20. FIG. 8 is a diagram illustrating the state in which the cassette deck 2 has been drawn out of the deck main body 20.

The attachment detection unit 4 has a switch portion 41 and a base portion 42. The switch portion 41 is provided so as to be movable with respect to the base portion 42 in the drawing-out direction and in the attachment direction for the cassette deck 2. The switch portion 41 is urged so as to move away from the base portion 42 (in the drawing-out direction). In the state in which the cassette deck 2 has been drawn out, the switch portion 41 protrudes to the maximum degree in the drawing-out direction with respect to the base portion 42 (OFF).

When the cassette deck 2 is inserted by the user, the rear surface 29 of the cassette deck 2 comes into contact with the switch portion 41, and the switch portion 41 is pushed-in with respect to the base portion 42. Through the pushing-in of the switch portion 41 with respect to the base portion 42, the attachment of the cassette deck 2 is detected (ON).

Assuming that the position of the distal end surface of the switch portion 41 in which the cassette deck 2 has been drawn out is 0, the distal end surface of the switch portion 41 is pushed in by an amount Lp by the rear surface 29, whereby the attachment detection unit 4 detects that the cassette deck 2 has been attached. On the other hand, when the amount by which the distal end surface of the switch portion 41 is pushed in by the rear surface 29 is less than Lp, the attachment of the cassette deck 2 is not detected.

Further, when the cassette deck 2 is attached to the deck main body 20, the drive connection gear 52 provided on the deck main body 20 and the elevation connection gear (drive receiving portion) 26 provided on the cassette deck 2 are brought into mesh with each other, whereby the rotation of the drive connection gear 52 is transmitted to the elevation connection gear 26 to rotate the elevation connection gear 26. The in-mesh width L of the drive connection gear 52 and the elevation connection gear 26 is determined based on the maximum weight of the sheets that can be stacked on the stacking plate 21. The larger the maximum weight of the sheets that can be stacked on the stacking plate 21, the larger the in-mesh width L that must be secured. Further, the in-mesh width L is designed not based on the in-mesh width La (FIG. 6) when the cassette deck 2 has been completely accommodated in the deck main body 20, but based on the in-mesh width Lb (FIG. 7) the moment that the attachment of the cassette deck 2 is detected by the attachment detection unit 4.

In the first exemplary embodiment, the drive of the elevation unit 22 is first connected in the process of inserting the cassette deck 2. After this, the attachment detection unit 4 detects the attachment of the cassette deck 2. Further, in the first exemplary embodiment, the stacking plate 21 is raised in response to the detection by the attachment detection unit 4 of the attachment of the cassette deck 2. To raise the stacking plate 21, it is necessary for the drive of the elevation unit 22 to be connected. Thus, in the process of inserting the cassette deck 2, it is necessary for the detection of the attachment of the cassette deck 2 to be effected prior to the connection of the drive of the elevation unit 22.

Conversely, in the process of drawing out the cassette deck 2, the drawing-out of the cassette deck 2 is first detected, and thereafter, the connection of the drive of the elevation unit 22 is released. When the cassette deck 2 has been drawn out until the connection of the drive of the elevation unit 22 is released, the stacking plate 21 descends due to its own weight.

Figure 13:
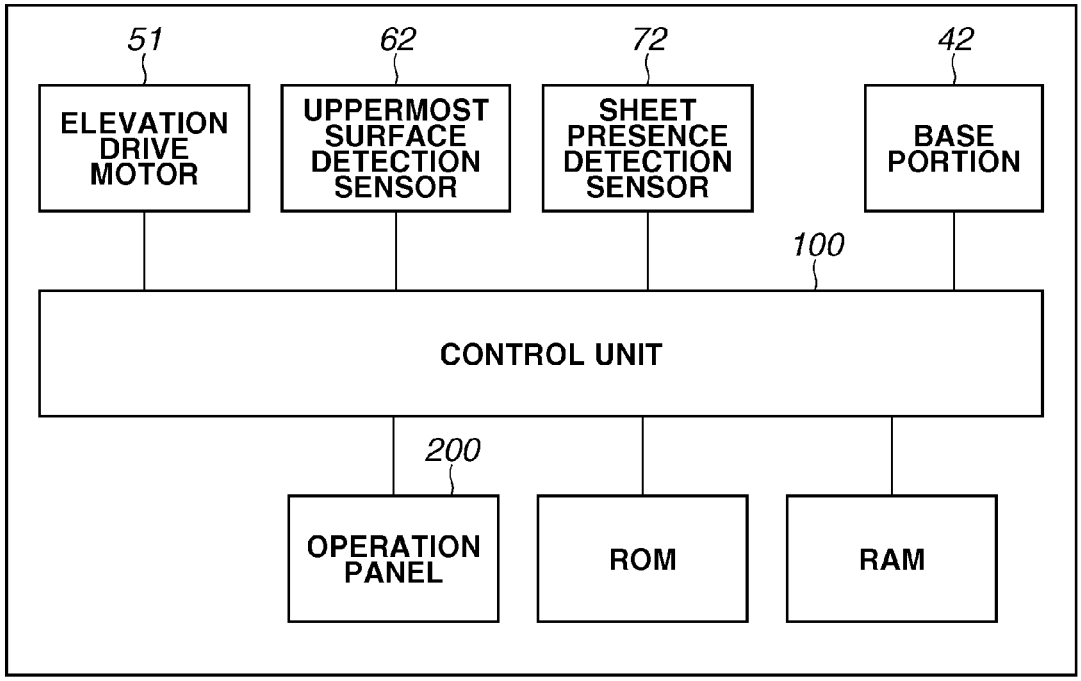
FIG. 13 is a block diagram illustrating the image forming apparatus according to the first exemplary embodiment.

Next, a control unit (central processing unit (CPU)) 100 of the image forming apparatus according to the first exemplary embodiment will be described. As illustrated in FIG. 13, a control unit 100 is connected to an elevation drive motor 51, an uppermost surface detection sensor 62, a sheet presence detection sensor 72, a base portion 42, and an operation panel 200. Further, the control unit 100 is connected to a read-only memory (ROM) and a random-access memory (RAM) (storage unit). By using the RAM as work memory, a program stored in the ROM storing a program corresponding to the procedures illustrated in FIG. 15 described below is executed.

Figure 9:
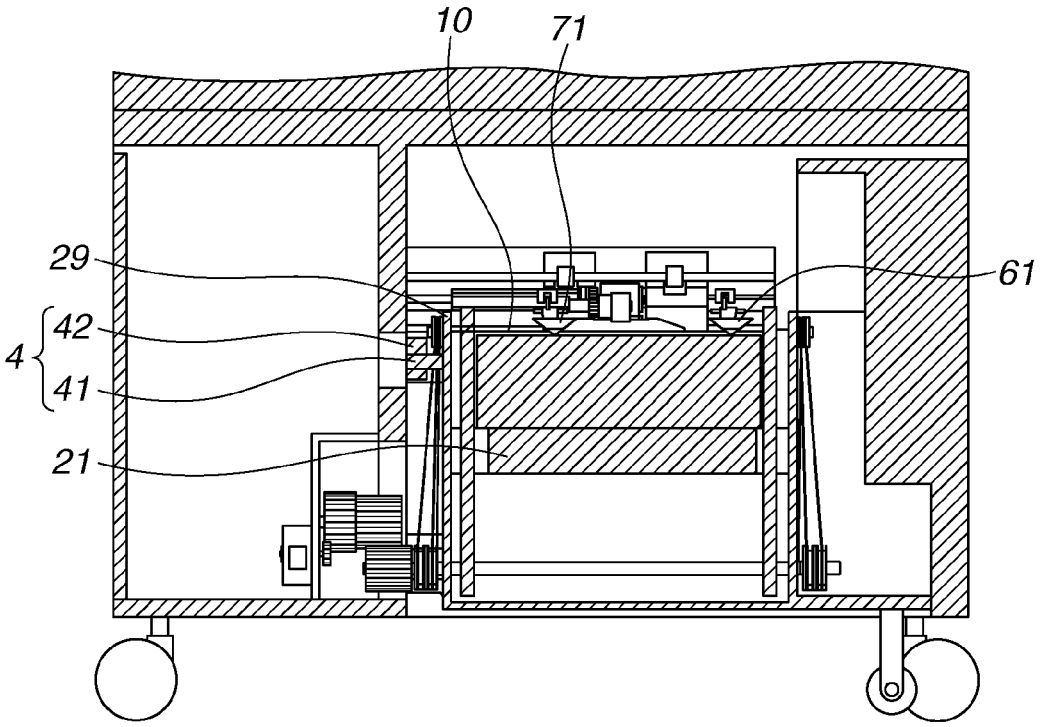
FIG. 9 is a diagram illustrating a state in which the cassette deck has been attached to the deck main body and in which the raising of the stacking plate has been completed.

When the attachment detection unit 4 detects the attachment of the cassette deck 2, the control unit 100 drivesthe elevation drive motor 51, and the stacking plate 21 is raised to a feeding-enabled position where it is detected by the uppermost surface detection sensor 62 (FIG. 9). When no sheet is detected by the sheet presence detection sensor 72 even when the stacking plate 21 is raised to the feeding-enabled position, the control unit 100 effects display on the operation panel 200 as the display unit, and prompts the user to perform replenishment of sheets.

When it is determined that the amount of sheets stacked on the stacking plate 21 is not less than a predetermined amount (This condition will be hereinafter referred to as overloading as appropriate), the control unit 100 performs no feeding operation. Further, the control unit 100 indicates (gives a warning of) overloading through the operation panel 200 of the image forming apparatus main body 1, requesting the user to remove extra sheets. In the overloading state, the pressure (feeding pressure) on the sheets when the feeding roller 31 descends becomes too high, resulting in high possibility of double feeding. As the method of inhibiting (restricting) the feeding operation by the control unit 100, it will be possible to adopt various methods including prevention of the descent of the feeding roller 31.

(1) In the case where the control unit 100 determines that there is overloading:

When the cassette deck 2 is drawn out of the deck main body 20 by the user, and the connection between the drive connection gear 52 and the elevation connection gear 26 is released, the stacking plate 21 descends to the lowermost position due its own weight as illustrated in FIG. 8. It is possible for the user to stack (replenish) sheets on the stacking plate 21 of the cassette deck 2.

Figure 10:
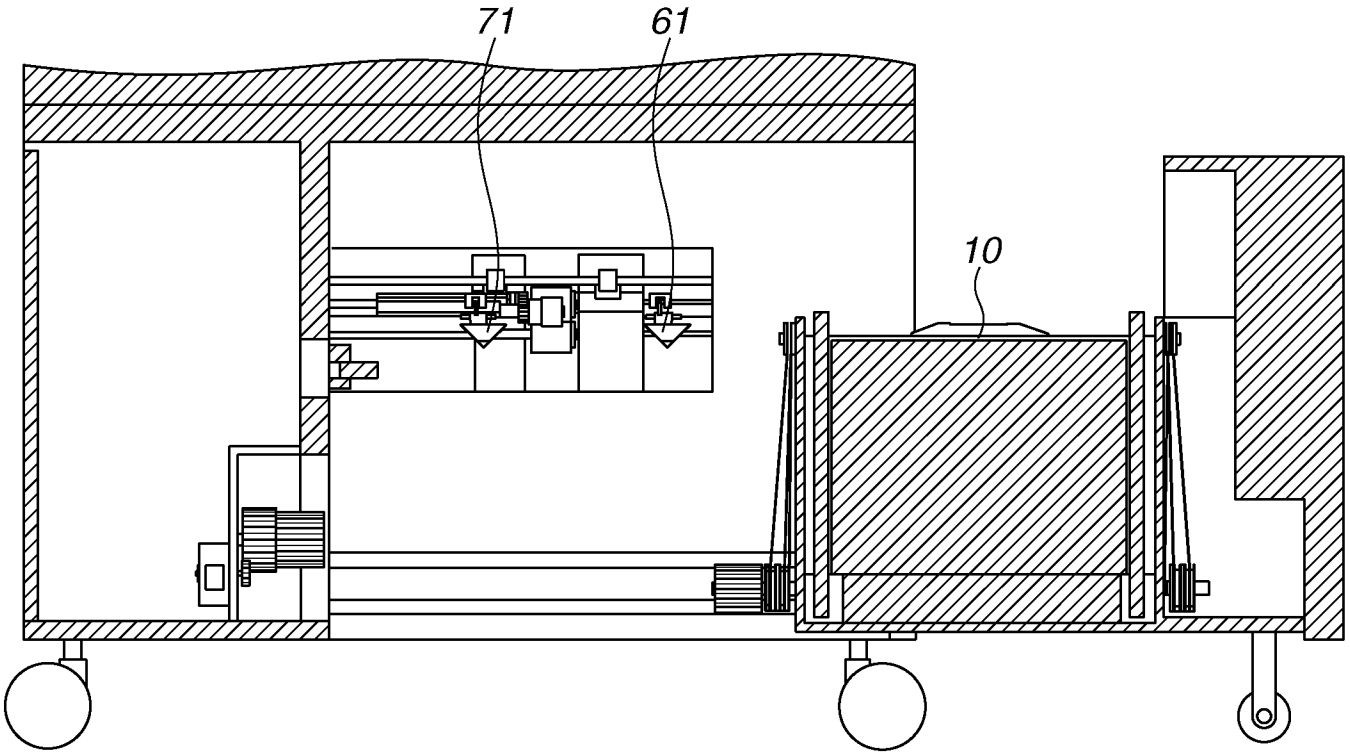
FIG. 10 is a diagram illustrating a state in which the cassette deck has been drawn out of the deck main body and in which sheets are stacked on the stacking plate in an amount not less than a predetermined amount (overloading amount).
Figure 11:
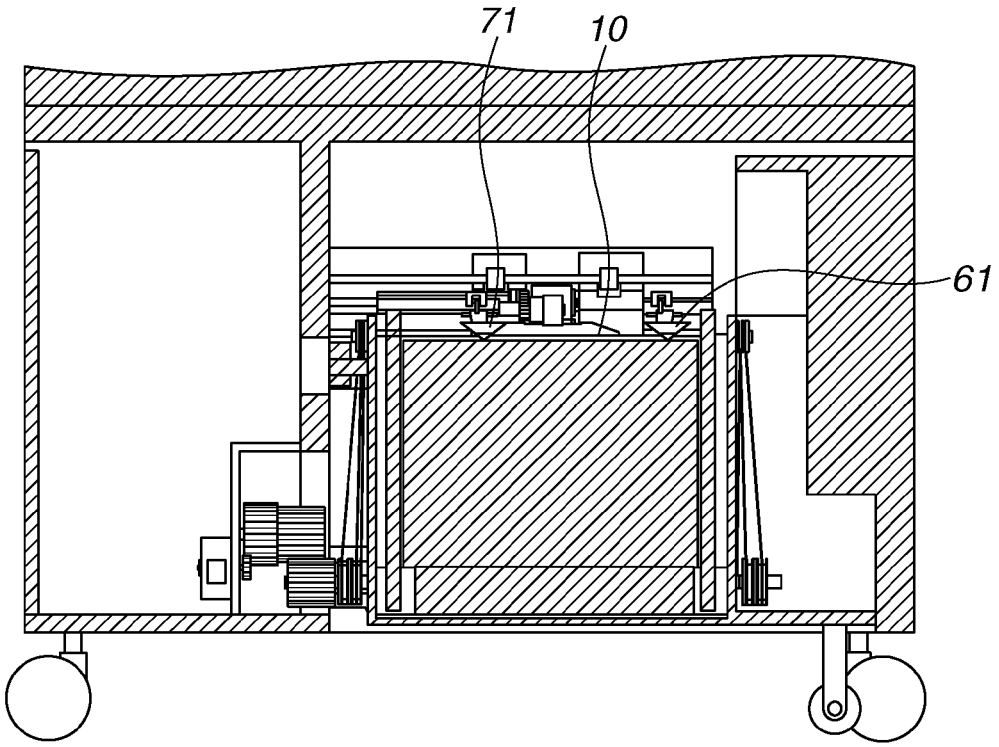
FIG. 11 is a diagram illustrating a state in which the cassette deck is attached to the deck main body in the overloaded state.

Then, as the user inserts the cassette deck 2 into the deck main body 20, the attachment of the cassette deck 2 is detected by the attachment detection unit 4 as described above. In response to the detection by the attachment detection unit 4 of the attachment of the cassette deck 2, the control unit 100 obtains the detection result from the uppermost surface detection unit 6. When a sheet on the stacking plate 21 is detected by the uppermost surface detection unit 6, the control unit 100 determines that there is overloading. As a result, when, as illustrated in FIGS. 10 and 11, the amount of sheets stacked on the stacking plate 21 is excessive, it is possible for the control unit 100 to determine that there is overloading.

On the other hand, when no sheet is detected by the uppermost surface detection unit 6, the control unit 100 does not determine that there is overloading. As described above, when the user draws out the cassette deck 2 until the drive-connection of the elevation unit 22 is released, it is possible to correctly detect sheet overloading by the control unit 100.

(2) When the control unit 100 does not determine that there is overloading:

As described above, however, in the process in which the user draws out the cassette deck 2, the connection between the drive connection gear 52 and the elevation connection gear 26 is released after the attachment detection unit 4 detects that the cassette deck 2 has been drawn out.

Figure 12:
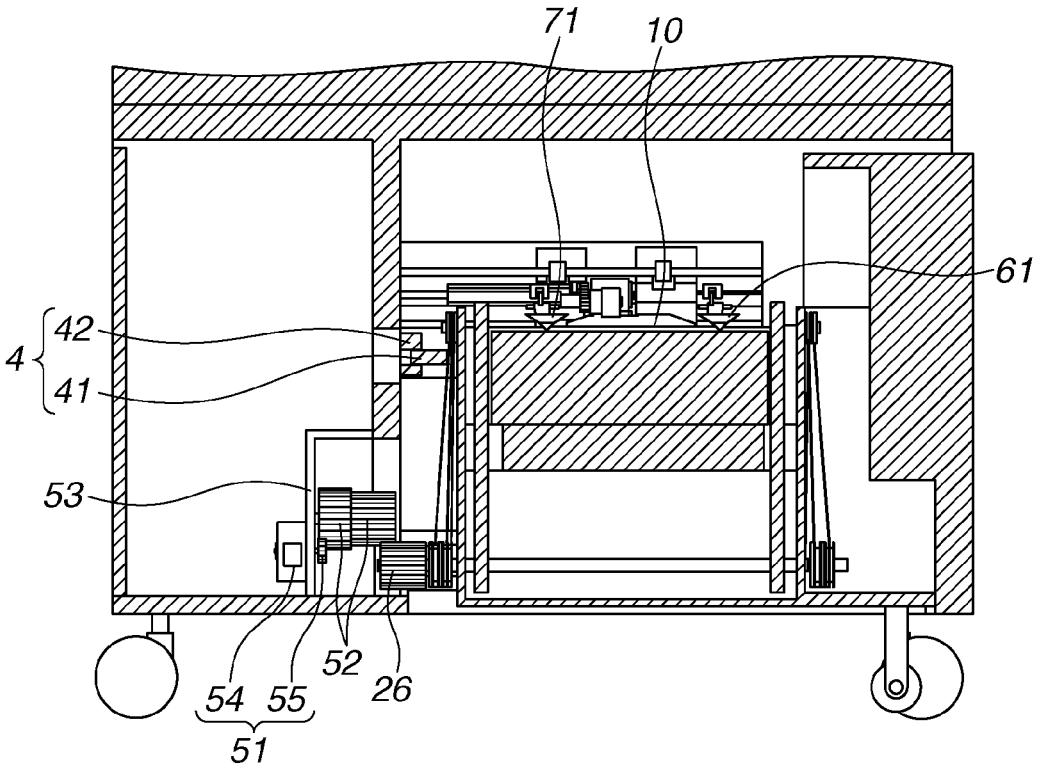
FIG. 12 is a diagram illustrating a state in which a storage unit according to the first exemplary embodiment has been slightly drawn out.

Thus, in the case where the user draws out the cassette deck 2 only slightly, it can happen that the connection between the drive connection gear 52 and the elevation connection gear 26 is not released although the attachment detection unit 4 has detected that the cassette deck 2 has been drawn out (FIG. 12). If the connection between the drive connection gear 52 and the elevation connection gear 26 is not released, and the stacking plate 21 remains raised by the elevation unit 22, this means that a sheet has been detected by the uppermost surface detection unit 6.

If, in this state, the control unit 100 makes the determination of the above item (1), it is erroneously determined that there is overloading even when in fact there is no overloading. That is, it can happen that it is erroneously determined that there is overloading solely through the determination by the control unit 100 as to whether there is overloading based on the detection result of the uppermost surface detection unit 6 in response to the detection by the attachment detection unit 4 of the attachment of the cassette deck 2 inserted by the user.

In view of this, in the first exemplary embodiment, the control unit 100 makes the following determination so that the control unit 100 will not erroneously determine that there is overloading in such cases.

When the uppermost surface detection unit 6 continues to detect a sheet in a series of processes in which the attachment detection unit 4 changes from the state in which it detects the attachment of the cassette deck 2 to the state in which it does not detect the cassette deck 2 and, further, to the state in which it detects the attachment of the cassette deck 2, the control unit 100 determines that there is no overloading. When the uppermost surface detection unit 6 continues to detect a sheet in the series of processes, if the connection between the drive connection gear 52 and the elevation connection gear 26 is not released, it is assumed that the amount of sheets stacked on the stacking plate 21 has not been changed.

Figure 14:
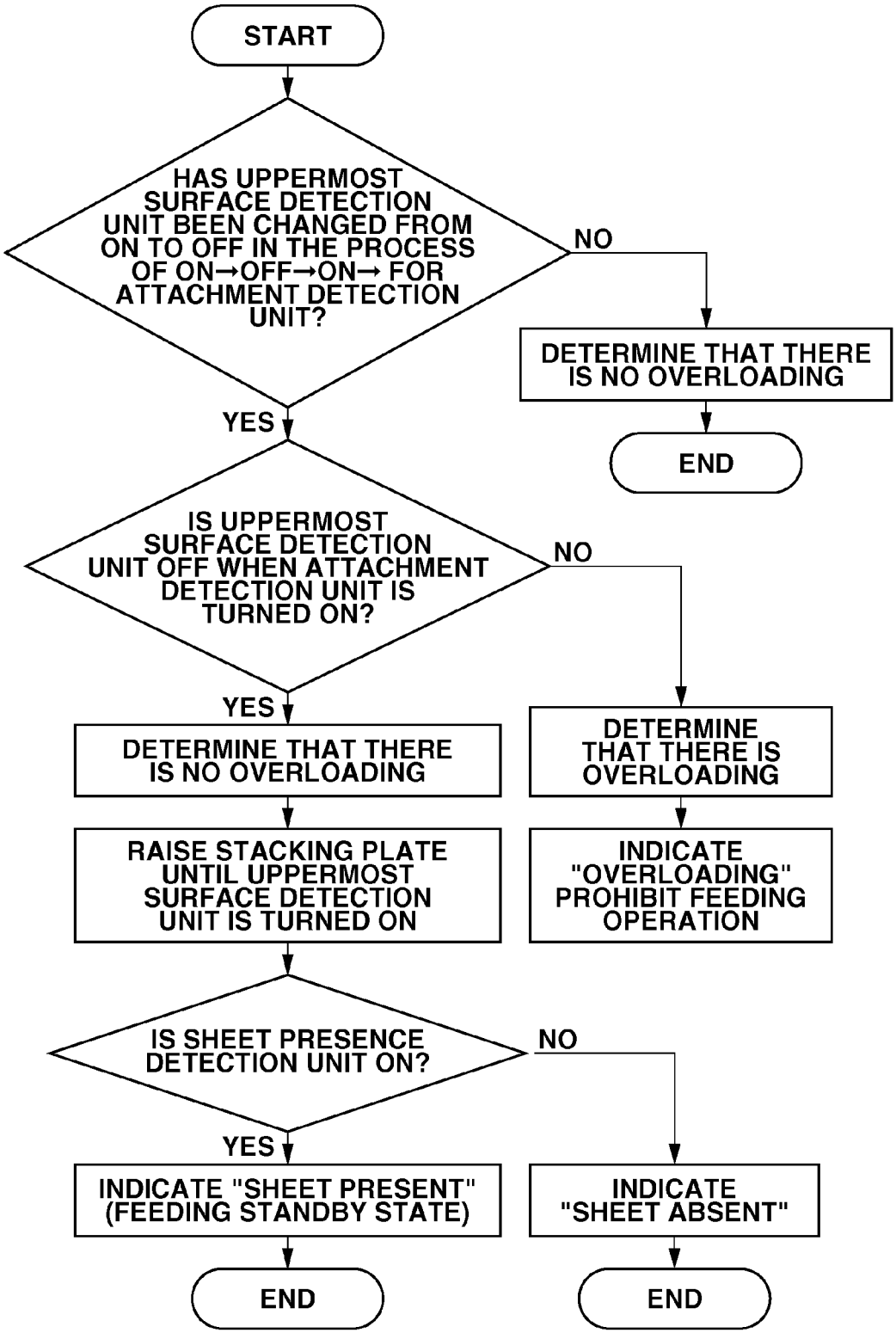
FIG. 14 is a flowchart illustrating the operation of the image forming apparatus according to the first exemplary embodiment.

FIG. 14 is a flowchart illustrating an operation of the image forming apparatus according to the first exemplary embodiment.

In this way, according to the first exemplary embodiment, the detection results of the uppermost surface detection unit 6 and of the attachment detection unit 4 are used, whereby it is possible to prevent erroneous detection of overloading without having to provide a dedicated sensor or the like for detecting overloading. This does not mean that the scope of application of the present invention is restricted to one where no dedicated sensor for detecting overloading is used.

Further, while in the first exemplary embodiment described above it is determined whether there is overloading by utilizing the detection result of the uppermost surface detection unit 6, the present invention is also applicable to a construction in which the detection result of the sheet presence detection unit 7 is utilized. Further, while in the first exemplary embodiment described above both the uppermost surface detection unit 6 and the sheet presence detection unit 7 are provided as the sheet detection unit, the present invention is also applicable to a construction employing only one of them.

Further, while in the first exemplary embodiment described above the elevation unit 22 elevates (raises) the stacking plate 21 in the vertical direction in a horizontal attitude, the present invention is also applicable to a construction in which the stacking plate 21 is rotated.

According to the first exemplary embodiment described above, the detection results of the uppermost surface detection unit 6 and of the attachment detection unit 4 are used, whereby it is possible to prevent erroneous detection of overloading. If, however, the amount of sheets stacked on the stacking plate 21 is really excessive, control of the above item (2) by the control unit 100 may result in erroneous detection of non-overloading when, in fact, there is overloading. In the following, a second exemplary embodiment which helps to prevent the above erroneous detection will be described. In describing the second exemplary embodiment, a description of the construction, operation, and control that are the same as those of the first exemplary embodiment will be left out as appropriate.

As in the first exemplary embodiment, also in the second exemplary embodiment, the control unit 100 determines whether there is overloading in response to the detection by the attachment detection unit 4 of the attachment of the cassette deck 2. At this time, the control unit 100 according to the second exemplary embodiment determines whether there is overloading by utilizing the previous determination as to whether there is overloading. That is, the control unit 100 determines that there is overloading in the case where the control unit 100 has determined there is overloading when the control unit 100 previously made determination as to whether there is overloading in response to the detection of the attachment of the cassette deck 2 by the attachment detection unit 4, and, further, where the uppermost surface detection unit 6 continues to detect a sheet in the series of processes in which the state in which the attachment of the cassette deck 2 is detected by the attachment detection unit 4 is changed to the state in which the attachment of the cassette deck 2 is not detected and, further, to the state in which the attachment of the cassette deck 2 is detected. It is to be assumed that the amount of sheets stacked on the stacking plate 21 has not changed since the uppermost surface detection unit 6 continues to detect a sheet from the state where it was determined by the control unit 100 that there was overloading.

Information related to the result of the determination by the control unit 100 as to whether there is overloading is can be stored in the RAM.

Figure 15:
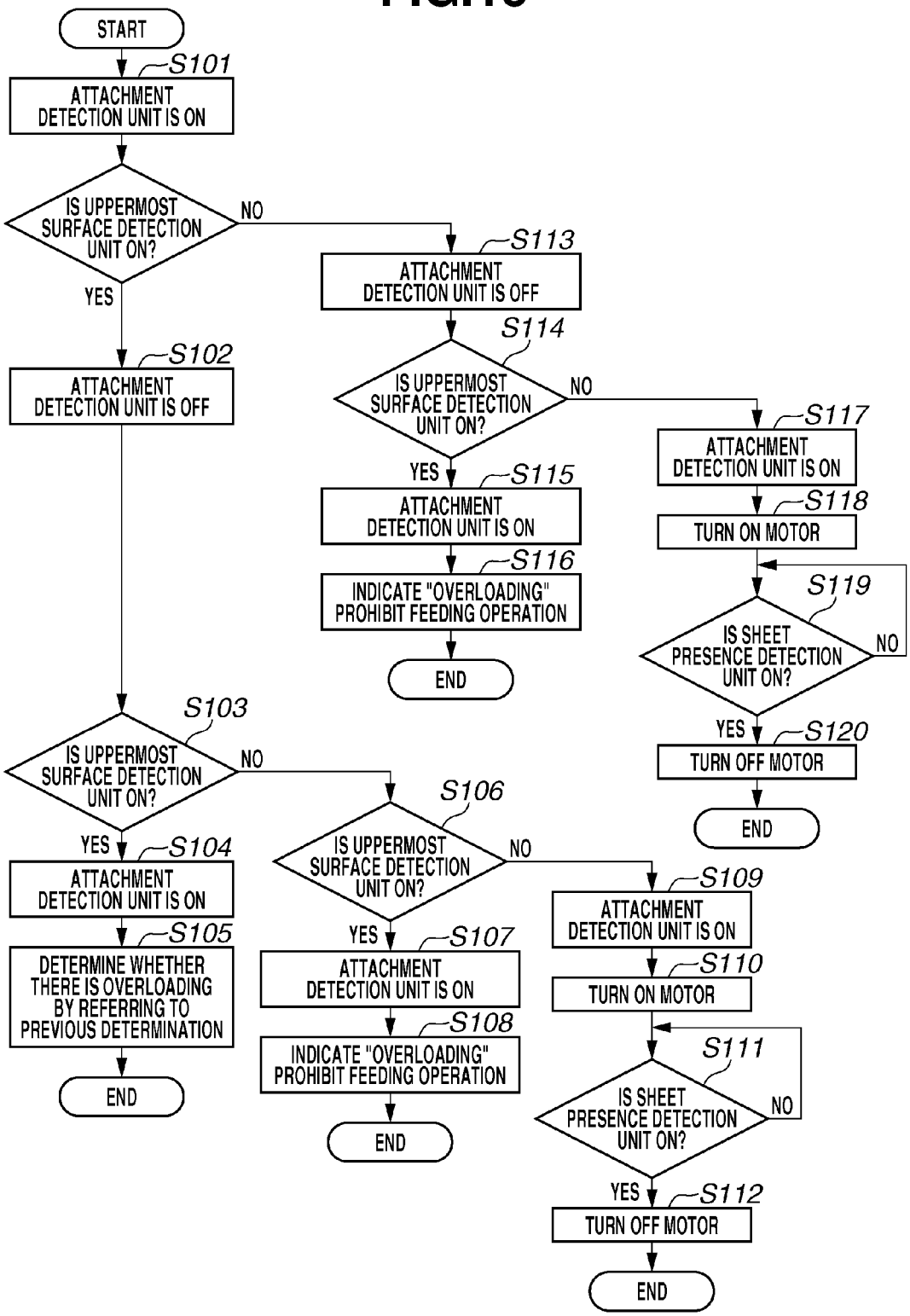
FIG. 15 is a flowchart illustrating the operation of an image forming apparatus according to a second exemplary embodiment.

FIG. 15 is a flowchart illustrating an operation by the image forming apparatus according to the second exemplary embodiment.

In step S101, i.e., in the state in which the cassette deck 2 is attached to the image forming apparatus main body 1, the attachment detection unit 4 outputs an ON signal. In step S102, the user draws the cassette deck 2 out of the image forming apparatus main body 1, whereby the signal output by the attachment detection unit 4 is changed from ON to OFF.

In step S103, the user inserts the cassette deck 2 into the image forming apparatus main body 1, whereby the control unit 100 determines whether the uppermost surface detection unit 6 has output the ON signal before the attachment detection unit 4 outputs the ON signal.

In the case where the uppermost surface detection unit 6 has output the ON signal in step S103, the user inserts the cassette deck 2 into the image forming apparatus main body 1, whereby the attachment detection unit 4 is turned ON in step S104. In this case, in step S105, the control unit 100 refers to the previous determination to determine whether there is overloading. When it is determined that there is overloading, the control unit 100 performs the same control as that in step S108 described below. When it determines that there is no overloading, the control unit 100 performs the same control as that in steps S110 to S112 described below.

When, in step S103, the uppermost surface detection unit 6 has output the OFF signal, it is to be assumed that the cassette deck 2 has been drawn out of the image forming apparatus main body 1. Thus, some sheets are stacked on the stacking plate 21 by the user. Thus, in step S106, when the user inserts the cassette deck 2 into the image forming apparatus main body 1, the control unit 100 determines once again whether the uppermost surface detection unit 6 outputs the ON signal before the attachment detection unit 4 outputs the ON signal.

In the case where the uppermost surface detection unit 6 outputs the ON signal, the user inserts the cassette deck 2 into the image forming apparatus main body 1, whereby the attachment detection unit 4 is turned ON in step S107. In this case, in step S108, the control unit 100 determines that there is overloading. It is to be assumed that sheets have been excessively stacked on the stacking plate 21 by the user. In this case, the control unit 100 indicates overloading through the operation panel 200 and, further, inhibits the feeding operation.

On the other hand, in step S110, when, in step S106, the uppermost surface detection unit 6 has output the OFF signal, the elevation drive motor 51 is turned ON based on the output of the ON signal (step S109) of the attachment detection unit 4. Then, in step S111, the control unit 100 raises the stacking plate 21 until the sheet presence detection unit 7 outputs the ON signal, and turns OFF the elevation drive motor 51 (step S112).

Further, in rare cases, it may occur, in step S113, that the uppermost surface detection unit 6 is OFF between step S101 and step S102. Examples of such cases include one in which the user inserts/extracts the cassette deck 2 before the lift-up of the stacking plate 21 has been completed.

In this case, in step S114, before the attachment detection unit 4 outputs the ON signal through the insertion of the cassette deck 2 into the image forming apparatus main body 1 by the user, the control unit 100 determines whether the uppermost surface detection unit 6 outputs the ON signal.

In step S115, when, in step S114, the uppermost surface detection unit 6 has output the ON signal, the attachment detection unit 4 is turned ON through the insertion of the cassette deck 2 into the image forming apparatus main body 1 by the user. In this case, in step S116, the control unit 100 determines that there is overloading, indicates overloading through the operation panel 200, and inhibits the feeding operation.

On the other hand, when, in step S114, the uppermost surface detection unit 6 has output the OFF signal, then in step S118, the control unit 100 turns ON the elevation drive motor 51 based on the output of the ON signal (step S117) of the attachment detection unit 4. Then, in step S119, the control unit 100 raises the stacking plate 21 until the uppermost surface detection unit 6 outputs the ON signal, and turns OFF the elevation drive motor 51 (step S120).

According to the second exemplary embodiment described above, in addition to the effect of the first exemplary embodiment, it is further possible to prevent erroneous detection of non-overloading when in fact there is overloading.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-007315 filed Jan. 18, 2013, which is hereby incorporated by reference herein in its entirety.

What is claimed is:

1. A sheet feeding device comprising:

a sheet storage unit configured to store sheets, wherein the sheet storage unit is configured to be attached to an apparatus main body and to be drawn from the apparatus main body;

a stacking portion provided in the sheet storage unit, wherein sheets are stacked on the stacking portion;

a raising unit configured to raise the stacking portion, wherein the stacking portion is configured to be lowered in response to the sheet storage unit being drawn from the apparatus main body;

a sheet detection unit configured to detect that an upper most sheet stacked on the stacking portion is positioned at a higher position that is higher than a sheet detection position in a vertical direction;

an attachment detection unit configured to detect that the sheet storage unit is attached to an attachment position of the apparatus main body; and a control unit configured to determine whether an amount of sheets stacked on the stacking portion exceeds a predetermined amount based on detection results of the sheet detection unit and the attachment detection unit, wherein, according to the sheet storage unit being drawn out of the attachment position of the apparatus main body in an amount exceeding a first amount, a state of the attachment detection unit changes from a first state in which the attachment of the sheet storage unit is detected to a second state in which the attachment of the sheet storage unit is not detected, wherein, according to the sheet storage unit being drawn out of the attachment position of the apparatus main body in an amount exceeding a second amount, a state of the sheet detection unit changes from a third state in which the uppermost sheet is detected to a fourth state in which the uppermost sheet is not detected, wherein the first amount by which the sheet storage unit is drawn out from the apparatus main body relative to the attachment position is smaller than the second amount by which the sheet storage unit is drawn out from the apparatus main body relative to the attachment position, wherein, in a case where the sheet storage unit is drawn out of the attachment position of the apparatus main body in an amount exceeding the first amount and less than or equal to the second amount, the attachment detection unit is in the second state in which the attachment of the sheet storage unit is not detected and the sheet detection unit is in the third state in which the uppermost sheet is detected, and wherein the control unit determines that the amount of sheets stacked on the stacking portion does not exceed the predetermined amount in a case where the detection result of the sheet detection unit does not change from the third state to the fourth state in a series of processes in which a detection result of the attachment detection unit changes from the first state to the second state, and further to the first state.

2. The sheet feeding device according to claim 1, wherein the control unit determines that the amount of sheets stacked on the stacking portion exceeds the predetermined amount in a case where a detection result of the sheet detection unit changes from the third state to the fourth state, and further to the third state in a series of processes in which a detection result of the attachment detection unit changes from the first state to the second state, and further to the first state.

3. The sheet feeding device according to claim 1, wherein the raising unit includes a drive source and a drive receiving portion, wherein the drive source is provided in the apparatus main body and is configured to generate a drive force and the drive receiving portion is provided in the sheet storage unit and is configured to receive the drive force from the drive source when connected to the drive source.

4. The sheet feeding device according to claim 3, wherein, in a process in which the sheet storage unit, drawn from the apparatus main body, is then attached to the apparatus main body, the attachment detection unit detects the attachment of the sheet storage unit after the drive source and the drive receiving portion are connected.

5. The sheet feeding device according to claim 4, wherein, in a case where the sheet storage unit is drawn from the apparatus main body and the connection between the drive source and the drive receiving portion is released, the stacking portion descends due to its own weight.

6. The sheet feeding device according to claim 1, further comprising a feeding unit configured to feed an uppermost sheet stacked on the stacking portion, wherein the control unit restricts a sheet feeding operation by the feeding unit in a case where the control unit determines that an amount of sheets stacked on the stacking portion exceeds the predetermined amount.

7. The sheet feeding device according to claim 1, wherein, in a case where the control unit determines that an amount of sheets stacked on the stacking portion exceeds the predetermined amount, the control unit displays a warning on a display unit provided on the apparatus main body.

8. The sheet feeding device according to claim 1, wherein, the control unit causes the raising unit to raise the sheet stacking portion in response to the attachment detection unit detecting the attachment of the sheet storage unit.

9. The sheet feeding device according to claim 1, wherein the sheet detection unit includes an uppermost surface detection unit configured to detect an uppermost sheet surface of sheets stacked on the stacking portion, and wherein the raising unit raises the stacking portion until the uppermost sheet surface is detected by the uppermost surface detection unit.

10. The sheet feeding device according to claim 1, wherein the sheet detection unit includes a sheet presence detection unit configured to detect whether a sheet is stacked on the stacking portion.

11. The sheet feeding device according to claim 1, wherein, in a case where, in the series of processes, a detection result of the sheet detection unit does not change from the third state to the fourth state after the control unit has determined that the amount of sheets stacked on the stacking portion exceeds the predetermined amount, the control unit continues to determine that the amount of sheets stacked on the stacking portion exceeds the predetermined amount.

12. An image forming apparatus, comprising the sheet feeding device according to claim 1.

13. The sheet feeding device according to claim 1, wherein the control unit determines that the amount of sheets stacked on the stacking portion exceeds the predetermined amount in a case where a detection result of the sheet detection unit changes from the fourth state to the third state in a series of processes in which a detection result of the attachment detection unit changes from the first state to the second state, and further to the first state.

14. The sheet feeding device according to claim 1, wherein, in a case where an amount of the sheet stacked on the stacking portion exceeds the predetermined amount, the upper most sheet stacked on the stacking portion is positioning at a position that is higher than the predetermined position in a state that the raising unit does not raise the stacking portion.

15. The sheet feeding device according to claim 1, wherein the sheet detection unit includes a contact member configured to move upward by being pushed by the upper most sheet stacked on the stacking portion and a sensor configured to detect the contact member being moved upward.

16. The sheet feeding device according to claim 1, wherein the control unit determines that the amount of sheets stacked on the stacking unit exceeds the predetermined amount when the sheet detection unit detects a sheet stacked on the stacking unit after the attachment detection unit detects the attachment of the sheet storage unit to the apparatus main body and before the raising unit raises the stacking unit by a second predetermined amount.

17. The sheet feeding device according to claim 1, wherein the control unit configured to determine whether an amount of sheets stacked on the stacking portion exceeds a predetermined amount as an overloaded sheet condition.

18. A sheet feeding device comprising:

a sheet storage unit configured to store sheets, wherein the sheet storage unit is configured to be attached to an apparatus main body and to be drawn from the apparatus main body;

a stacking portion provided in the sheet storage unit, wherein sheets are stacked on the stacking portion;

a raising unit configured to raise the stacking portion, wherein the stacking portion is configured to be lowered in response to the sheet storage unit being drawn from the apparatus main body;

a sheet detection unit configured to detect that an upper most sheet stacked on the stacking portion is positioned at a higher position that is higher than a sheet detection position in a vertical direction;

an attachment detection unit configured to detect that the sheet storage unit is attached to an attachment position of the apparatus main body; and a control unit configured to determine whether an amount of sheets stacked on the stacking portion exceeds a predetermined amount based on detection results of the sheet detection unit and the attachment detection unit, wherein, according to the sheet storage unit being drawn out of the attachment position of the apparatus main body in an amount exceeding a first amount, a state of the attachment detection unit changes from a first state in which the attachment of the sheet storage unit is detected to a second state in which the attachment of the sheet storage unit is not detected, wherein, according to the sheet storage unit being drawn out of the attachment position of the apparatus main body in an amount exceeding a second amount, a state of the sheet detection unit changes from a third state in which the uppermost sheet is detected to a fourth state in which the uppermost sheet is not detected, wherein the first amount by which the sheet storage unit is drawn out from the apparatus main body relative to the attachment position is smaller than the second amount by which the sheet storage unit is drawn out from the apparatus main body relative to the attachment position, wherein, in a case where the sheet storage unit is drawn out of the attachment position of the apparatus main body in an amount exceeding the first amount and less than or equal to the second amount, the attachment detection unit is in the second state in which the attachment of the sheet storage unit is not detected and the sheet detection unit is in the third state in which the uppermost sheet is detected, wherein the control unit determines that the amount of sheets stacked on the stacking portion exceeds the predetermined amount in a case where the detection result of the sheet detection unit changes from the third state to the fourth state in a series of processes in which a detection result of the attachment detection unit changes from the first state to the second state, and further to the first state, in a case where the sheet detection unit is not in the fourth state when the attachment detection unit changes from the second state to the first state, and wherein the control unit determines that the amount of sheets stacked on the stacking portion does not exceed the predetermined amount in a case where a detection result of the sheet detection unit does not change from the third state to the fourth state in a series of processes in which a detection result of the attachment detection unit changes from the first state to the second state, and further to the first state.

19. An image forming apparatus, comprising the sheet feeding device according to claim 18.

20. A sheet feeding device comprising:

a sheet storage unit configured to store sheets, wherein the sheet storage unit is configured to be attached to an apparatus main body and to be drawn from the apparatus main body;

a stacking portion provided in the sheet storage unit, wherein sheets are stacked on the stacking portion;

a raising unit configured to raise the stacking portion, wherein the stacking portion is configured to be lowered in response to the sheet storage unit being drawn from the apparatus main body;

a feeding unit configured to feed sheets stacked on the stacking portion;

a sheet detection unit configured to detect that an upper most sheet stacked on the stacking portion is positioned at a higher position that is higher than a sheet detection position in a vertical direction, wherein, according to the sheet storage unit being drawn out of the attachment position of the apparatus main body in an amount exceeding a first amount, a state of an attachment detection unit changes from a first state in which the attachment of the sheet storage unit is detected to a second state in which the attachment of the sheet storage unit is not detected, wherein, according to the sheet storage unit being drawn out of the attachment position of the apparatus main body in an amount exceeding a second amount, a state of the sheet detection unit changes from a third state in which the uppermost sheet is detected to a fourth state in which the uppermost sheet is not detected, wherein the first amount by which the sheet storage unit is drawn out from the apparatus main body relative to the attachment position is smaller than the second amount by which the sheet storage unit is drawn out from the apparatus main body relative to the attachment position, wherein, in a case where the sheet storage unit is drawn out of the attachment position of the apparatus main body in an amount exceeding the first amount and less than or equal to the second amount, the attachment detection unit is in the second state in which the attachment of the sheet storage unit is not detected and the sheet detection unit is in the third state in which the uppermost sheet is detected, wherein a control unit restricts the control unit restrict the sheet feeding operation by the feeding unit in a case where a detection result of the sheet detection unit changes from the third state to the fourth statein a series of processes in which a detection result of the attachment detection unit changes from the first state to the second state, and further to the first state, in a case where the sheet detection unit is not in the fourth state when the attachment detection unit changes from the second state to the first state, and wherein the control unit does not restrict the sheet feeding operation by the feeding unit in a case where the detection result of the sheet detection unit does not change from the third state to the fourth state in a series of processes in which a detection result of the attachment detection unit changes from the first state to the second state, and further to the first state.

21. An image forming apparatus, comprising the sheet feeding device according to claim 20.

22. A sheet feeding device comprising:

a sheet storage unit configured to store sheets, wherein the sheet storage unit is configured to be attached to an apparatus main body and to be drawn from the apparatus main body;

a stacking portion provided in the sheet storage unit, wherein sheets are stacked on the stacking portion;

a raising unit configured to raise the stacking portion, wherein the stacking portion is configured to be lowered in response to the sheet storage unit being drawn from the apparatus main body;

a sheet detection unit configured to detect that an upper most sheet stacked on the stacking portion is positioned at a higher position that is higher than a predetermined position in a vertical direction;

an attachment detection unit configured to detect attachment of the sheet storage unit to the apparatus main body; and a control unit configured to determine whether an amount of sheets stacked on the stacking portion exceeds a predetermined amount as an overloaded sheet condition based on detection results of the sheet detection unit and the attachment detection unit, wherein, in a case where the sheet detection unit continuously detects a sheet while the attachment detection unit goes through an attachment detection process in which the attachment detection unit (i) detects the sheet storage unit attached to the apparatus main body due to the sheet storage unit being drawn from the apparatus main body, then (ii) detects the sheet storage unit as not attached to the apparatus main body, and then (iii) detects the sheet storage unit as attached to the apparatus main body, the control unit determines that the amount of sheets stacked on the stacking portion does not exceed the predetermined amount as an overloaded sheet condition.

* * * * *